US006123745A

United States Patent [19]

Hess, III et al.

[11] Patent Number: 6,123,745

[45] Date of Patent: Sep. 26, 2000

[54] CONCRETE FORM WITH INTEGRAL DRAIN AND REINFORCING BAR SUPPORT BRACKET THEREFOR

[75] Inventors: John Hess, III; Harold Hess, both of Belleville, Ill.

[73] Assignee: Hess Bros, L.L.C., Fairview Heights, Ill.

[21] Appl. No.: 09/165,603

[22] Filed: Oct. 2, 1998

Related U.S. Application Data

[63] Continuation-in-part of application No. 08/864,931, May 29, 1997, Pat. No. 5,884,439.

[51] Int. Cl.[7] ..... E04C 5/16; E02B 11/00; E02D 15/00

[52] U.S. Cl. ..... 51/677; 52/678; 52/684; 52/699; 52/700; 52/742.14; 52/169.5; 249/30

[58] Field of Search ..... 52/677, 678, 684, 52/712, 294, 699, 700, 742.14, 169.5; 248/302, 73, 74.1, 74.2; 249/30, 5, 207, 219.1

[56] References Cited

U.S. PATENT DOCUMENTS

| | | | |
|---|---|---|---|
| 499,549 | 6/1893 | Hunter et al. | 248/302 |
| 631,317 | 8/1899 | Miller . | |
| 649,367 | 5/1900 | Seiler | 248/302 X |
| 816,473 | 3/1906 | Johnson | 248/302 X |
| 1,236,354 | 8/1917 | Bloomberg | 248/302 |
| 1,321,842 | 11/1919 | Otto | 248/302 X |
| 1,325,807 | 12/1919 | Siemann | 248/302 X |
| 1,698,467 | 1/1929 | Ashkenas | 248/302 X |
| 1,712,801 | 5/1929 | White | 52/684 |
| 2,848,888 | 8/1958 | Jones . | |
| 3,017,722 | 1/1962 | Smith . | |
| 3,263,026 | 7/1966 | Kihs | 248/74.1 X |
| 3,384,158 | 5/1968 | Rothenbach | 248/74.2 X |
| 3,521,332 | 7/1970 | Kramer | 248/74.2 X |
| 3,521,842 | 7/1970 | Opperthauser | 248/74.2 |
| 3,613,323 | 10/1971 | Hreha . | |
| 3,722,164 | 3/1973 | Schmidgall | 52/684 |
| 3,883,934 | 5/1975 | Rochfort | 248/302 X |
| 4,301,638 | 11/1981 | Schmidgall | 52/687 |
| 4,640,063 | 2/1987 | Ayala . | |
| 4,702,048 | 10/1987 | Millman . | |
| 4,809,941 | 3/1989 | Sheridan | 248/302 X |
| 4,915,346 | 4/1990 | Burdett | 249/219.1 X |
| 4,939,883 | 7/1990 | Swenson | 52/677 X |
| 4,941,629 | 7/1990 | Horn | 248/73 X |
| 5,042,218 | 8/1991 | Nasca et al. | 52/677 |
| 5,120,162 | 6/1992 | Parker . | |
| 5,224,799 | 7/1993 | Parker . | |
| 5,388,804 | 2/1995 | Cohen et al. | 52/699 X |
| 5,406,758 | 4/1995 | Baum . | |
| 5,586,416 | 12/1996 | Hess, III et al. . | |
| 5,884,439 | 3/1999 | Hess, III et al. | 52/155 |

OTHER PUBLICATIONS

Certain Teed *Form–A–Drain* Product Information and Advantages, 1994.

Richmond *Reinforcing Bar Supports*, Bulletin No. 7, 1978.

*Primary Examiner*—Robert Canfield

*Attorney, Agent, or Firm*—Howell & Haferkamp, LC

[57] ABSTRACT

An adjustable concrete form comprises at least one tube and an adjustable stake having a post and a tube cradle. A bracket is removably connected to the tube for supporting rebar in spaced-apart relation to the excavation bottom. The bracket includes a tube engaging portion and a rebar supporting portion. The tube engaging portion is configured for connecting the bracket to the tube. The rebar supporting portion extends laterally from a proximal end connected to the tube engaging portion to a distal end spaced from the tube engaging portion.

14 Claims, 5 Drawing Sheets

CONCRETE FORM WITH INTEGRAL DRAIN AND REINFORCING BAR SUPPORT BRACKET THEREFOR

This is a continuation-in-part application of commonly owned U.S. application Ser. No. 08/864,931, which was filed on May 29, 1997 now U.S. Pat. No. 5,884,439.

BACKGROUND OF THE INVENTION

This invention relates generally to footing/foundation forms for the construction of concrete foundations, and more particularly to reinforcing bar ("rebar") support brackets used in connection with such forms for supporting rebar in spaced-apart relation to an excavation bottom.

Use of rebar in the construction of concrete foundations is known in the art. One commonly employed means for supporting rebar above an excavation bottom is a the use of a plurality of support stands which are arranged by the site laborer at spaced intervals and placed directly upon the excavation bottom between the concrete forms. Rebar is placed on the support stands and the stands are left in place as concrete is poured between the forms.

Another prior art means for supporting rebar above an excavation bottom is disclosed in U.S. Pat. No. 5,224,799. The '799 patent discloses a support member comprised of an elongate piece of metal formed into the upper portion of a "castellated surface." The support member is mounted between two parallel forms with the lateral legs of the castellated surface engaging the parallel forms. A horizontal cross-member connects the lateral legs and spans across the excavation bottom. Rebar may be supported above the excavation bottom by the horizontal cross-member.

A problem with these prior art means for supporting rebar above an excavation bottom is that, once installed, they limit the ability of the site laborer to access the areas of the excavation bottom between the two forms. Support stands or support members which span across the excavation bottom between the forms make it difficult for site laborers to, for example, remove accumulated debris from the excavation bottom prior to placing the rebar and pouring the concrete. Another problem with support members which are mounted between two parallel forms and which span across the excavation bottom is that support members of different lengths may be needed depending on the spacing of the parallel forms. Thus, the present invention overcomes problems of the prior art by providing a rebar support bracket which is mounted to only one of the forms such that the rebar may be supported at only one end in a cantilevered fashion, rather than being mounted between two parallel forms and supported across the excavation bottom, as in the prior art.

SUMMARY OF THE INVENTION

The present invention represents an improvement over the stake and footing/foundation form of U.S. Pat. No. 5,586,416 as well as pending U.S. patent application Ser. No. 08/864,931. Generally, in accordance with the present invention, a concrete form comprises at least one hollow drain tube and a reinforcing bar (rebar) support bracket. The tube has at least one aperture providing the form with integral drainage. The bracket is removably connected to the tube and supports rebar in spaced-apart relation to the excavation bottom. The bracket includes a tube engaging portion and a rebar supporting portion. The tube engaging portion is configured for connecting the bracket to the tube. The rebar supporting portion extends laterally from a proximal end connected to the tube engaging portion to a distal end spaced from the tube engaging portion.

While the principal advantages and features of the present invention have been described above, a more complete and thorough understanding and appreciation for the invention may be attained by referring to the drawings and description of the preferred embodiments which follow.

BRIEF DESCRIPTION OF THE DRAWINGS

Reference characters in the written specification indicate corresponding parts throughout the several views of the drawings.

DETAILED DESCRIPTION OF THE PREFERRED EMBODIMENT

Figure 1:
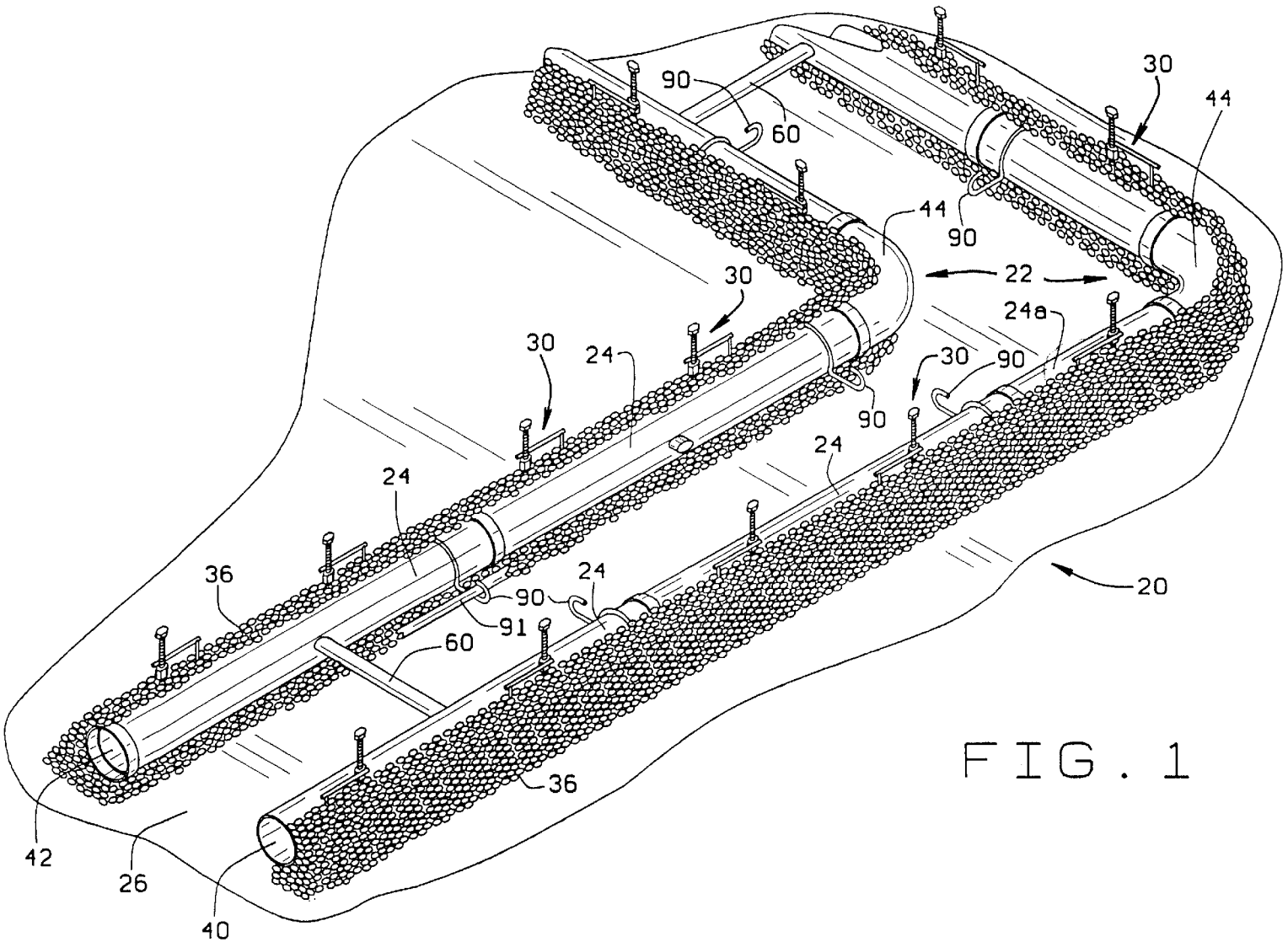
FIG. 1 is an isometric view of a concrete form of the present invention shown with gravel filled between the form and an excavation bottom.
Figure 2:
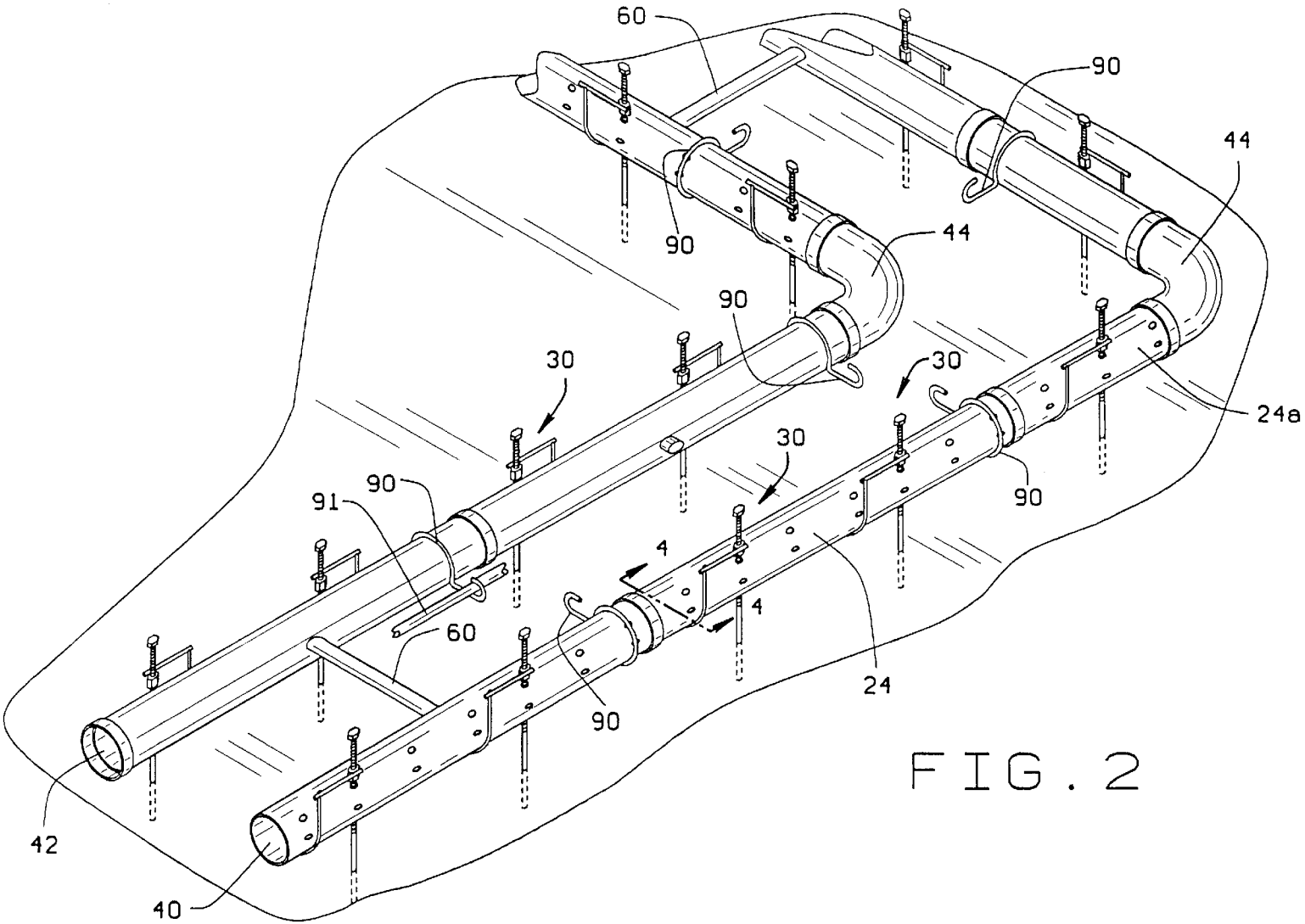
FIG. 2 is an isometric view of the concrete form of FIG. 1 with the gravel fill removed to better illustrate the rebar support brackets and the adjustable stakes used with the present invention.
Figure 3:
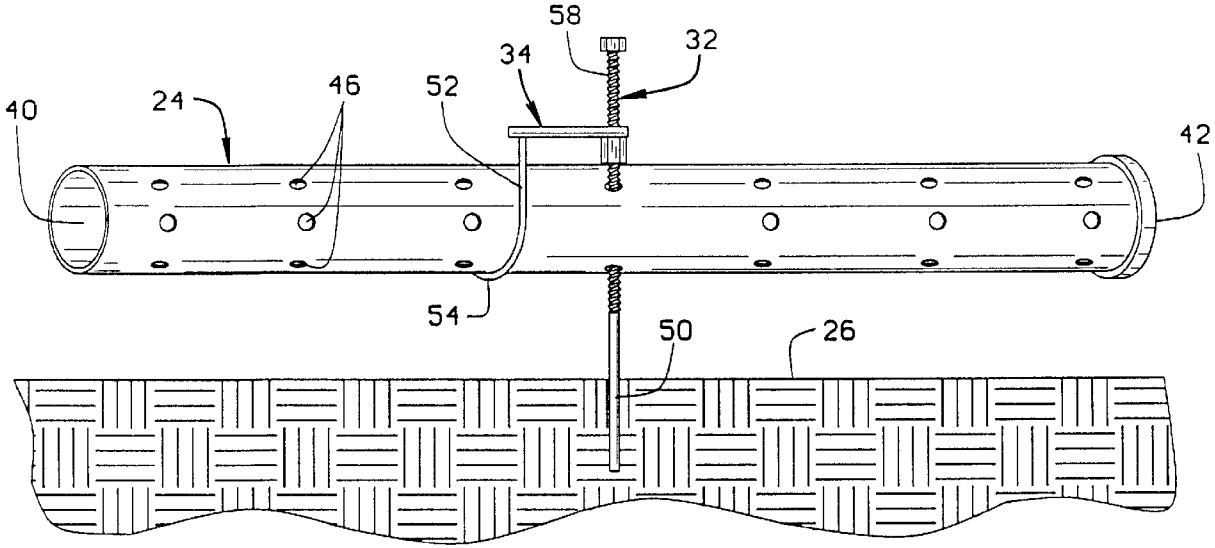
FIG. 3 is a side elevational view of one tube of the present invention showing the adjustable stake in a snap-fit engagement with the tube.
Figure 4:
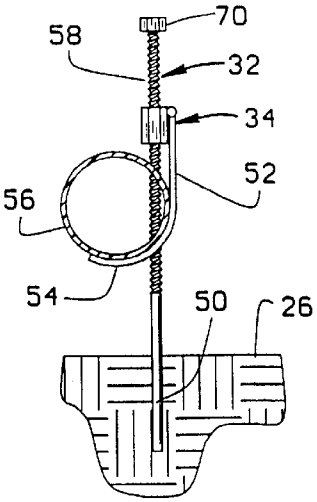
FIG. 4 is a cross-sectional view taken along the plane of line 4—4 in FIG. 2 showing the adjustable stake in a snap-fit engagement with the tube.

Referring to FIGS. 1 through 4, an adjustable concrete form of the present invention is indicated generally by the reference numeral 20. The form 20 includes two substantially parallel, spaced apart, serpentuitous walls 22 for retaining concrete poured therebetween. Each wall includes a plurality of hollow tubes 24 linked end to end. As best shown in FIG. 2, the tubes are secured in spaced relation to an excavation bottom 26 by a plurality of adjustable stakes 30. Each adjustable stake 30 is comprised of a post 32 and a tube cradle 34. The post 32 and the tube cradle 34 are an integral structure formed of two pieces: a post and a cradle connected to the post. Preferably, gravel 36 is filled beneath the elevated tubes 24 (see FIG. 1).

The disclosure of commonly owned U.S. Pat. No. 5,586,416, is incorporated herein by reference. In the preferred embodiment of the present invention, the tubes 24 are 10-foot polyethylene tubes having a 4 inch diameter. However, polyvinyl chloride (PVC) tubes and tubes made of other materials could be used as well without departing from the scope of the present invention. Although 10-foot tubes having a 4 inch diameter are preferred, tubes having other lengths and other diameters could be used without departing from the scope of the present invention.

While being transported to the excavation site, and while being stored at the site prior to installation, the tubes 24 may be exposed to sunlight for extended periods of time. In order to avoid softening or other damage to the tubes 24 caused by extended exposure to sunlight, in the preferred embodiment at least an exterior surface of the tubes 24 is white, or another reflective color, so that sunlight is reflected away from the tubes 24.

The tubes 24 each include a male end 40 and a female end 42 to enable convenient end-to-end connection of multiple tubes. Various shaped elbows 44 (i.e. 30°, 45°, 60°, 90°, etc.) are provided to enable the end-to-end connection of the tubes in a serpentuitous path. The elbows 44 preferably include two female ends which allow any tube 24 to be cut precisely where a change in wall direction is desired and the cut tube will conveniently mate with any elbow 44. Tube 24*a* in FIGS. 1 and 2 illustrates a tube cut to meet design specifications which conveniently mates with the 90° elbow 44.

In the preferred embodiment, each tube includes three longitudinal rows of holes 46 (see FIG. 3) arranged at approximately 30°, 90°, and 150° (viewed from the male end). The holes 46 are preferably ⅝ inches in diameter and spaced 5 inches center-to-center. As illustrated in FIGS. 1 and 2, the holes 46 face away from the footing/foundation allowing liquid therearound to enter the tubes 24 thereby providing the form 20 with integral drainage. Drain tubes (not shown) are connected periodically to the tubes 24 providing a fluid conduit to a sewer or sump pump thereby enabling liquid adjacent the footing/foundation to be removed therefrom.

The preferred embodiment uses gravel 36 between the elevated tubes 24 and the excavation bottom 26 such that both the tubes 24 and the gravel 36 engage and form the concrete poured between walls 22. The gravel is preferably filled to grade (as shown in FIG. 1) level with the top of the tubes 24 thereby providing a leach field for the longitudinal rows of holes 46 and enabling liquid adjacent the footing/foundation to drain through the tubes 24. It is understood that filler stone, rock, or another suitable material may be used in place of (or in combination with) the gravel 36 without departing from the scope of this invention.

The term "tube" is used in a broad sense to include an elongated member that will function as a conduit for water as in a drainage system. It may be of round, rectilinear, or other suitable cross-section. It is also to be understood that the term "excavation" as used herein may be a hole, trench, or other preparation of an earthen surface for receipt of a footing/foundation. Further, while the preferred embodiment uses a pair of spaced apart, serpentuitous walls 22, it is understood that a single wall 22 (constructed as described above) may be employed without departing from the spirit of this invention. Moreover, to minimize the risk of termites and the like, the tubes 24, elbows 44, posts 32, and tube cradles 34 are preferably constructed of non-degradable material.

Each post 32 has at least one slender end 50 to facilitate driving the post partially into the excavation bottom 26. Preferably, the post 32 is cut from steel rod commonly available in the construction field, but could be constructed of other rigid materials. The post 32 is inserted through one 30° hole and its corresponding 150° hole of the tube 24. Each tube cradle 34 is configured for releasable engagement with the tube 24 to thereby secure the tube relative to the post 32 and to support the tube 24 in spaced-apart relation to the excavation bottom 26.

Each tube cradle 34 is moveable relative to the tube 24 between locked and unlocked positions. When in the locked position (see FIGS. 3 and 4), the cradle 34 is releasably engaged with the tube 24 in a manner to secure the tube 24 relative to the post 32 and to support the tube 24 in spaced-apart relation to the excavation bottom 26. When the cradle 34 is moved to the unlocked position, the cradle 34 disengages the tube 24 so that the tube 24 is permitted to move freely relative to the post 32.

The tube cradle 34 includes a handle portion 48 and a member 52. The member 52 is configured for resilient engagement with an exterior surface 56 of the tube 24 when the cradle 34 is in the locked position. The member 52 includes a hook portion 54 at its distal end dimensioned to receive a portion of the exterior surface of the tube in a releasable, snap-fit engagement when the cradle 34 is in the locked position. Preferably, the member 52 itself is somewhat resilient to facilitate engagement of the member 52 with the tube 24 as the cradle 34 is moved from the unlocked to the locked position. Also preferably, the tube 24 itself is somewhat resilient to further facilitate engagement of the member 52 with the tube 24 as the cradle 34 is moved from the unlocked to the locked position. The degree of resiliency of the member 52 may be selected depending on the rigidity of the tube 24.

Figure 7:
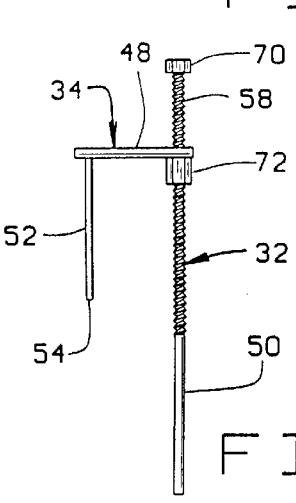
FIG. 7 is an enlarged rear elevational view of the adjustable stake of FIGS. 5 and 6.
Figure 6:
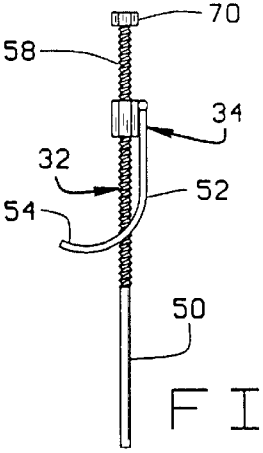
FIG. 6 is an enlarged end view of the adjustable stake of FIG. 5.
Figure 5:
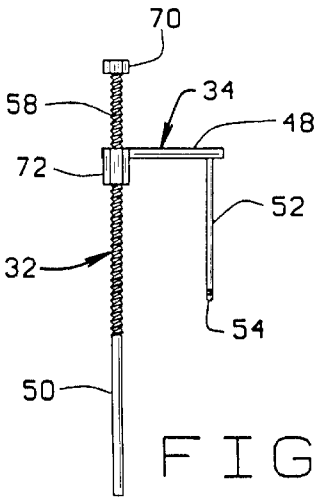
FIG. 5 is an enlarged front elevational view of the adjustable stake of the present invention.

The post 32 and the cradle 34 are adjustably connected to one another so that the position of the cradle 34 can be vertically adjusted relative to the post 32. Preferably, the post 32 and the cradle 34 are connected to one another in a threaded engagement so that rotation of the post 32 and cradle 34 relative to one another effectuates linear advancement of the cradle 34 relative to the post 32, i.e., rotational movement of the post 32 relative to the cradle 34 is translated into linear movement of the cradle 34 relative to the post 32. In the preferred embodiment, the cradle 34 includes an internally threaded hexagonal nut (or sleeve) which circumscribes the post 32. The nut 72 mates with an externally threaded portion 58 of the post 32 (see FIGS. 5 through 7).

As described above, the tube 24 and the cradle 34 are releasably locked relative to one another when the cradle 34 is in the locked position. Therefore, when the cradle 34 is in the locked position, rotation of the post 32 and cradle 34 relative to one another effectuates linear advancement of the both the cradle 34 and the tube 24 relative to the post 32 and relative to the excavation bottom 26, i.e., rotational movement of the post 32 relative to the cradle 34 is translated into linear movement of both the cradle 34 and the tube 24 relative to the post 32 and relative to the excavation bottom 26. The externally threaded portion 58 of the posts 32 also enhances the frictional engagement of the posts 32 with the tubes 24 at the points where the posts 32 are passed through the holes 46.

In the preferred embodiment, the surface of the slender end 50 of each post 32 is smooth and does not include threads or flutes. The smooth surface permits rotational movement of the post 32 relative to the excavation bottom 26 without the post being urged further into, or out of, the ground.

Spacing the longitudinal rows of holes 46 at 30°, 90°, and 150°, as in the preferred embodiment, provides several benefits. This positioning allows the posts 32 to be passed through corresponding 30° and 150° holes and driven into the excavation bottom 26 substantially normal (i.e., at about 90°) with respect to excavation bottom. Driving the post 32 at substantially 90° minimizes misalignment of the walls 22 as they are elevated off of the excavation bottom which often occurs if the posts are driven at a non-orthogonal angle. This annular hole arrangement also assures that at least some of the holes 46 are on the bottom half of the tube 24. Because gravel 36 is filled below the tubes 24, positioning multiple of the holes 46 on the bottom half of the tube 24 allows fluid to enter the tubes from below thereby enabling expeditious drainage and allows silt/sediment to gravity flow from the tubes which minimizes the possibility of the tubes clogging over time. While not illustrated, the tubes may include holes at 180° to enhance this benefit.

The preferred embodiment describes an excavation having a generally level bottom such that the gravel 36 poured under and around the tubes 24 and elbows 44 rests on substantially the lowest plane of the excavation. However, without departing from the scope or spirit of this invention, the excavation bottom may be tiered or sloped such that the gravel 36 does not rest on the lowest plane thereof.

In operation, the site laborer prepares an excavation 26 to the appropriate depth and dimensions to accommodate the desired footing/foundation form 10. The inside and/or outside corner points of the footing/foundation wall are surveyed and a string or chalk line is placed around the intending footing/foundation perimeter. The tubes 24 are laid such that the holes 46 face generally outward. Elbows 44 are positioned and the tubes 24 are cut where appropriate to conform to the desired footing/foundation shape.

As more fully described in U.S. Pat. No. 5,586,416, which has been incorporated herein by reference, cross-over pipes 60 may be employed. The cross-over pipes 60 provide proper spacing between pairs of tubes 24 when coupled therebetween. Reinforcing bars ("rebars") are supported in the space between pairs of tubes 24 as hereinafter described.

Once the tubes and elbows are properly outlined around the footing/foundation perimeter, the posts 32 of the adjustable stakes 30 are placed through the 30° and 150° holes approximately every 5 feet. In the preferred embodiment two stakes 30 are employed for each tube. The posts 32 are driven partially into the ground and the tubes are elevated approximately to grade. A typical footing/foundation is 8 inches deep therefore the tubes and elbows are raised such that they are approximately 8 inches from the excavation bottom measured from their tops. Although the posts 32 are preferably driven partially into the ground, in an alternative method the site laborer pre-drills holes for the posts 32 and then inserts the posts 32 into the holes.

As the tubes 24 and elbows 44 are elevated to grade, the tube cradles 34 are rotated relative to their respective posts 32 to their locked positions with the cradles 34 in a resilient, snap fit engagement with the tubes 24. Thus, with the cradles 34 in their locked position, the tubes 24 and elbows 44 are secured to the posts 32 and are supported above the excavation bottom 26 approximately to grade.

In the preferred embodiment, the heights of the tubes 24 and elbows 44 relative to the excavation bottom 26 can be further adjusted to bring them to grade by altering the relative relationship of the post 32 and the cradle 34. As discussed above, the posts 32 and the cradles 34 are preferably connected to one another in a threaded engagement so that rotation of the posts 32 relative to the cradles 34 effectuates linear advancement of the cradles 34 relative to the posts 32. Thus, when the cradles 34 are in their locked position, rotational movement of the posts 32 is translated into linear movement of both the cradles 34 and the tubes 24 relative to the posts 32 and vertical adjustment of the tubes 24 relative to the excavation bottom 26.

Therefore, in the preferred embodiment, gross vertical adjustment of the tubes 24 and elbows 44 relative to the excavation bottom 26 can be accomplished with the cradles 34 in their unlocked position, and further vertical adjustment (fine adjustment) can be accomplished after the cradles 34 are moved to their locked position by rotating the posts 32. As best shown in FIGS. 3 through 7, each post 32 includes a hexagonal head 70. Both the head 70 and the nut 72 are configured to be gripped between the jaws of conventional wrenches to facilitate turning of the post 32. Although the head 70 and nut 72 are depicted in the Figures as being hexagonal, other polygonal configurations may be used. The head 70 also provides a broader striking surface to facilitate driving of the posts 32 into the excavation bottom 26.

Once the tubes 24 and elbows 44 are properly secured to grade, gravel 36 is filled beneath the elevated tubes and elbows, and extends adjacent the holes 46 flush with the top of the tubes and elbows.

Figure 8:
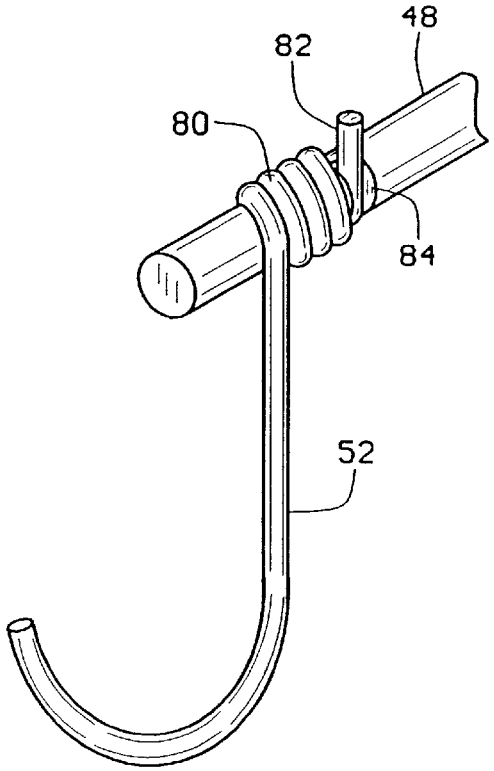
FIG. 8 is an enlarged, fragmented isometric view showing an alternative embodiment of the tube cradle having a coil spring.

In the preferred embodiment, the member 52 of the cradle 34 is rigidly connected to the handle portion 48, such as by being welded. However, FIG. 8 shows an alternative embodiment of the tube cradle 34 wherein the member 52 includes a coil spring 80 at its proximal end. The coil spring 80 is coiled around the handle portion 48 of the cradle 34 and includes an end coil 82. The handle portion 48 includes a groove 84 configured for receiving the end coil 82 in a manner to secure the member 52 to the handle portion 48. The coil spring 80 permits the member 52 to be deflected relative to the handle portion 48 and relative to the post 32. Use of the coil spring 80 adds to the resiliency of the member 52 and facilitates engagement and disengagement of the cradle 34 with the exterior surface 56 of the tube 24.

Figure 9:
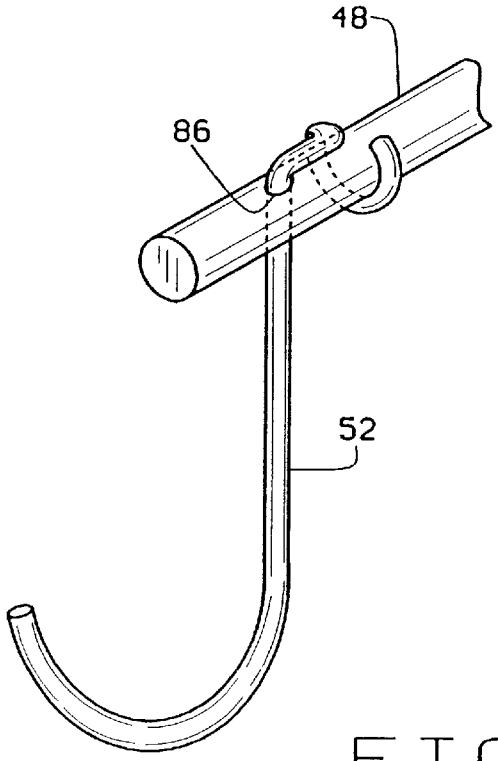
FIG. 9 is an enlarged, fragmented isometric view showing an alternative embodiment of the tube cradle having a resilient member which passes through a hole in a handle portion of the tube cradle.

FIG. 9 shows another alternative embodiment of the tube cradle 34 wherein the handle portion 48 includes a hole 86 which passes therethrough. The proximal end of the member 52 passes through the hole 86 and is then coiled around the handle portion 48 to secure the member 52 thereto.

In the embodiments of the present invention described above, the axial relationship of the posts 32 to the excavation bottom 26 remains substantially fixed while the positions of the tubes 24 and elbows 44 are adjusted relative to the posts 32. However, in another alternative embodiment of the present invention, the axial relationship of the posts to the excavation bottom changes while the relationship of the posts to the tubes and elbows remains fixed. In this alternative embodiment, the nut of the cradle is in a bearing engagement with the post, rather than a threaded engagement, so that the cradle is rotatable relative to the post but not axially movable. In this alternative embodiment, the slender end of the post is threaded (or fluted) so that rotational movement of the post relative to the excavation bottom urges the post further into, or out of, the ground. Thus, in this alternative embodiment, as with the other embodiments described above, a connection between the post and cradle allows rotation of the post relative to the cradle such that rotation of the post relative to the cradle effectuates height adjustment of the tubes and elbows.

Figure 10:
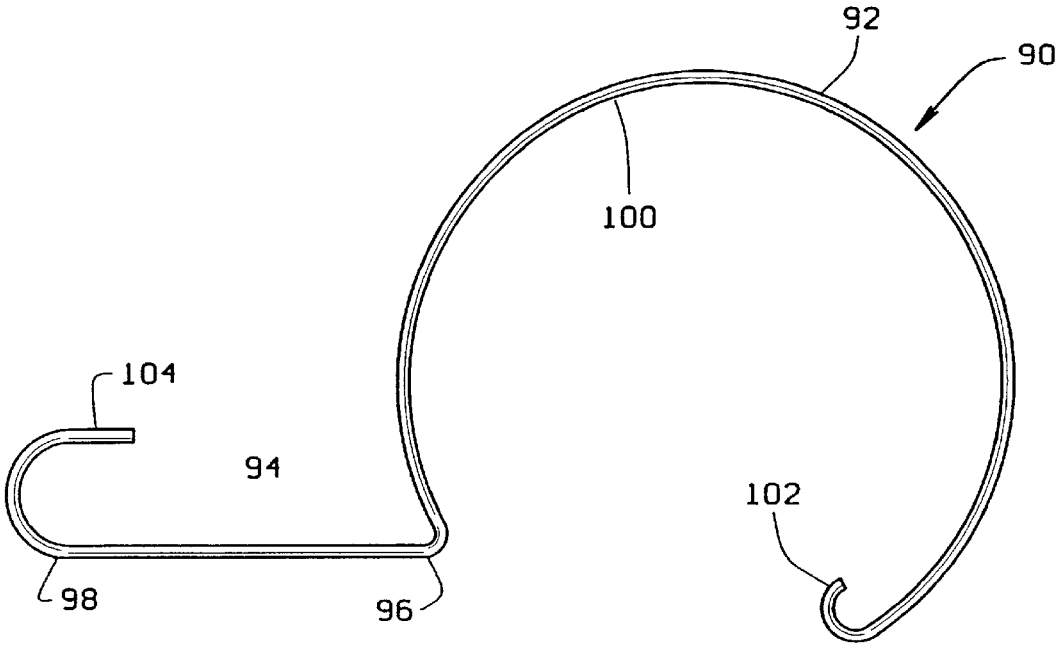
FIG. 10 is a side elevational view of a rebar support bracket of the present invention.
Figure 11:
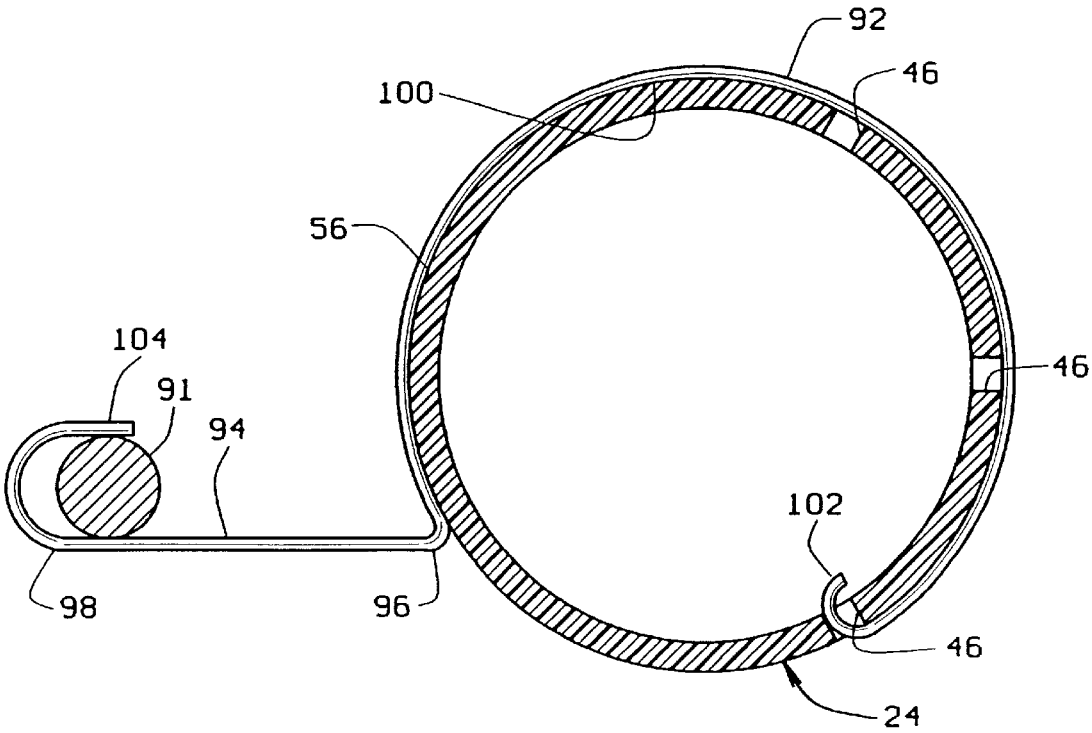
FIG. 11 is an enlarged cross-sectional view of a tube with the rebar support bracket of FIG. 10 mounted thereto with the bracket supporting a piece of rebar.

As shown in FIGS. 10 and 11, the concrete form of the present invention also includes a reinforcing bar (rebar) support bracket 90. The bracket 90 is removably connected to the tube 24 and supports rebar 91 in spaced-apart relation to the excavation bottom 26. The bracket 90 includes a tube engaging portion 92 and a rebar supporting portion 94. The tube engaging portion 92 is configured for connecting the bracket 90 to the tube 24. The rebar supporting portion 94 extends laterally from a proximal end 96 connected to the tube engaging portion 92 to a distal end 98 spaced from the tube engaging portion 92. Preferably, the tube engaging portion 92 and the rebar supporting portion 94 are an integral structure formed from a single, continuous piece of steel rod or wire. However, these components could be formed from other materials or as separate parts joined together, and could have other configurations without departing from the scope of the present invention.

The tube engaging portion 92 includes a curved tube receiving portion 100 configured to receive and circumscribe a portion of the exterior surface 56 of the tube 24. Preferably, the curved tube receiving portion 100 is somewhat resilient and is configured to circumscribe more than 180° of the exterior surface 56 of the tube 24. Therefore, when the bracket 90 is mounted to the tube 24, the tube receiving portion 100 is in a resilient, snap-fit engagement with the tube.

The tube engaging portion 92 also includes a hook 102 configured for engagement with one of the drainage apertures 46. As shown in FIG. 11, the hook 102 preferably engages an aperture 46 located at 150° in order to secure the bracket 90 to the tube 24. As discussed above, the holes 46 are preferably spaced along the length of the tubes on 5 inch centers. Therefore a plurality of brackets 90 can be mounted to each tube 24 as needed for supporting rebar.

The rebar supporting portion 94 of the bracket 90 includes a stop 104 at its distal end 98 for preventing rebar (not shown) from falling off of the bracket inadvertently. As shown in FIGS. 10 and 11, the stop 104 may take the form of a simple hook or bend in the rod or wire. However, any structure which serves to hold rebar in place on the rebar supporting portion 94 will suffice.

Once the tubes 24 have been secured to grade with the stakes 30, the site laborer mounts a plurality of the brackets 90 to the tubes 24. First, the hook 102 is brought into engagement with the drainage hole 46. Then, the tube receiving portion 100 is brought into resilient engagement with a portion of the exterior surface 56 of the tube 24.

Each of the brackets 90 is mounted to only one tube 24 such that the rebar support portion 94 is supported at only one end in a cantilevered fashion, rather than being mounted between two parallel tubes and supported across the excavation bottom as in the prior art (See U.S. Pat. No. 5,224,799). Therefore, the excavation bottom 26 between two parallel tubes 24 can be accessed easily by the site laborer even after the brackets 90 are installed. Accordingly, the site laborer can remove any debris from the excavation bottom 26 immediately prior to placing the rebar and pouring the concrete. Also, since each of the brackets 90 is mounted to only one tube 24, the same brackets can be used regardless of the spacing of two parallel tubes.

After the brackets 90 are in place, rebar can be supported from the brackets in spaced-apart relation to the excavation bottom 26. The engagement of the hook 102 with the hole 46 prevents the bracket 90 from slipping out of position due to the weight of the rebar being supported by the rebar supporting portion 94 of the bracket. Finally, concrete is poured between the spaced-apart forms and around the rebar and brackets 90. The brackets 90 serve to secure the tubes 24 to the footing after the concrete has solidified around the brackets.

In view of the above, it will be seen that improvements over the prior art have been achieved and other advantageous results attained.

As various changes could be made in the above constructions without departing from the scope of the invention, it is intended that all matter contained in the above description or shown in the accompanying drawings shall be interpreted as illustrative and not in a limiting sense. It should be understood that other configurations of the present invention could be constructed, and different uses could be made, without departing from the scope of the invention as set forth in the following claims.

What is claimed is:

1. A concrete form comprising:

at least one hollow drainage tube; and a bracket removably connected to the tube for supporting rebar in spaced-apart relation to an excavation bottom, the bracket comprising:

a tube engaging portion configured for connecting the bracket to the tube, the tube engaging portion of the bracket having a tube receiving portion configured to receive and circumscribe a portion of the tube; and a rebar supporting portion extending laterally from a proximal end connected to the tube engaging portion to a distal end spaced from the tube engaging portion, the rebar supporting portion being supported only at one end in a cantilevered fashion;

wherein the tube receiving portion is configured for resilient engagement with the portion of the tube.

2. The concrete form of claim 1 wherein the resilient engagement of the tube receiving portion with the portion of the tube is a releasable, snap-fit engagement.

3. The concrete form of claim 1 wherein the rebar supporting portion of the bracket includes a stop at its distal end for retaining rebar supported by the bracket.

4. The concrete form of claim 1 wherein the tube engaging portion and the rebar supporting portion are an integral structure formed from a single, continuous piece.

5. The concrete form of claim 1 further comprising an adjustable stake, said adjustable stake comprising:

a post having at least one slender end adapted to facilitate driving the post partially into the excavation bottom;

a tube cradle configured for releasable engagement with the tube to thereby secure the tube relative to the post, the post and the cradle being movably connected to another so that movement of the post effectuates adjustment of the tube relative to the excavation bottom when the post is at least partially driven into the excavation bottom.

6. A bracket for use with a concrete form, the form including at least one hollow drain tube, the bracket comprising:

a tube engaging portion configured for connecting the bracket to the tube; and a rebar supporting portion extending laterally from a proximal end connected to the tube engaging portion to a distal end spaced laterally from the tube engaging portion, the rebar supporting portion being supported only at its proximal end in a cantilevered fashion, the rebar supporting portion being configured for supporting rebar in spaced-apart relation to an excavation bottom;

wherein the tube engaging portion includes a hook configured for engagement with an aperture of the tube for securing the bracket to the tube.

7. The bracket of claim 6 wherein the tube engaging portion includes a tube receiving portion configured to receive and circumscribe a portion of the tube.

8. The bracket of claim 6 wherein the tube receiving portion is configured for resilient engagement with a portion of the tube.

9. The bracket of claim 8 wherein the resilient engagement of the tube receiving portion with the portion of the tube is a releasable, snap-fit engagement.

10. The bracket of claim 6 wherein the rebar supporting portion includes a stop at its distal end for retaining rebar supported by the bracket.

11. The bracket of claim 6 wherein the tube engaging portion and the rebar supporting portion are an integral structure formed from a single, continuous piece.

12. A concrete form comprising:

at least one hollow drainage tube; and a bracket removably connected to the tube for supporting rebar in spaced-apart relation to an excavation bottom, the bracket comprising:

a tube engaging portion configured for connecting the bracket to the tube, the tube engaging portion of the bracket having a tube receiving portion configured to receive and circumscribe a portion of the tube; and a rebar supporting portion extending laterally from a proximal end connected to the tube engaging portion to a distal end spaced from the tube engaging portion, the rebar supporting portion being supported only at one end in a cantilevered fashion;

wherein the tube engaging portion of the bracket includes a hook configured for engagement with an aperture of the tube for securing the bracket to the tube.

13. A method of constructing a concrete form with integral drainage, the method comprising the steps of:

excavating a concrete receiving area;

placing a hollow drain tube in position with respect to a bottom of the excavation;

mounting by resilient engagement a rebar support bracket to the tube in a manner so that a rebar supporting portion of the rebar support bracket is supported only at one end in a cantilevered fashion with a tube engaging portion of the bracket in engagement with the tube and the rebar supporting portion of the bracket spaced laterally from the tube; and supporting rebar with the rebar supporting portion of the bracket so the rebar is in spaced-apart relation to the excavation bottom.

14. The method of claim 13 wherein the bracket includes a hook, and wherein the step of mounting the bracket includes the step of securing the bracket to the tube by bringing the hook into engagement with an aperture of the tube.

* * * * *